US009755301B2

(12) United States Patent
Sharaiha et al.

(10) Patent No.: US 9,755,301 B2
(45) Date of Patent: Sep. 5, 2017

(54) CIRCULARLY POLARIZED COMPACT HELICAL ANTENNA

(71) Applicant: Tagsys, La Ciotat (FR)

(72) Inventors: Ala Sharaiha, Acigne (FR); Sylvain Collardey, Saint-pere Marc en Poulet (FR); Narcisse Rimbault, Sainte Radegonde (FR); Christophe Loussert, Aix en Provence (FR)

(73) Assignee: TAGSYS, La Ciotat (FR)

( * ) Notice: Subject to any disclaimer, the term of this patent is extended or adjusted under 35 U.S.C. 154(b) by 102 days.

(21) Appl. No.: 14/409,782

(22) PCT Filed: Jun. 24, 2013

(86) PCT No.: PCT/IB2013/055182

§ 371 (c)(1),
(2) Date: Dec. 19, 2014

(87) PCT Pub. No.: WO2013/190532

PCT Pub. Date: Dec. 27, 2013

(65) Prior Publication Data

US 2015/0155619 A1 Jun. 4, 2015

Related U.S. Application Data

(60) Provisional application No. 61/663,324, filed on Jun. 22, 2012.

(30) Foreign Application Priority Data

Mar. 19, 2013 (FR) ..... 13 52446

(51) Int. Cl.
*H01Q 1/42* (2006.01)
*H01Q 1/36* (2006.01)
(Continued)

(52) U.S. Cl.
CPC ..... *H01Q 1/362* (2013.01); *H01Q 1/2216* (2013.01); *H01Q 1/425* (2013.01); *H01Q 1/48* (2013.01);
(Continued)

(58) Field of Classification Search
CPC ..... H01Q 13/18; H01Q 1/286; H01Q 1/42; H01Q 1/36
(Continued)

(56) References Cited

U.S. PATENT DOCUMENTS 3,961,333 A * 6/1976 Purinton ..... H01Q 1/425 343/872
4,494,117 A * 1/1985 Coleman ..... H01Q 11/08 342/365
(Continued)

FOREIGN PATENT DOCUMENTS

JP H 03 72703 3/1991
JP 2004-254168 9/2004
(Continued)

OTHER PUBLICATIONS

AntennaFrequencyScalingTheARRLAntennaBook 1988pp. 2-24to2-25*
(Continued)

*Primary Examiner* — Dameon E Levi
*Assistant Examiner* — Collin Dawkins
(74) *Attorney, Agent, or Firm* — Brinks Gilson & Lione

(57) ABSTRACT

The present invention relates to a circularly polarized directional helical antenna that is capable of being used in RFID devices and more particularly in RFID readers. The antenna is intended to transmit or receive signals in a predetermined frequency band, λ being the wavelength associated with the minimum frequency of the predetermined frequency band. It includes a helicoidal radiating element made of conductive material extending along a longitudinal axis (A) and the axial length (H) of which is less than the wavelength λ, and a cavity made of conductive material having an open end and a closed end and having an axis of symmetry that coincides with the longitudinal axis of the radiating element, at least one lower portion of the radiating element being arranged inside the cavity so that its lower end is in contact with the closed end of the cavity.

5 Claims, 5 Drawing Sheets

(51) Int. Cl.

| | |
|---|---|
| ***H01Q 1/22*** | (2006.01) |
| ***H01Q 1/48*** | (2006.01) |
| ***H01Q 11/08*** | (2006.01) |
| ***H01Q 15/00*** | (2006.01) |
| ***H01Q 15/16*** | (2006.01) |

(52) U.S. Cl.
CPC ..... *H01Q 11/08* (2013.01); *H01Q 15/0013* (2013.01); *H01Q 15/0086* (2013.01); *H01Q 15/165* (2013.01)

(58) Field of Classification Search
USPC ..... 343/789, 786, 795, 895
See application file for complete search history.

(56) References Cited

U.S. PATENT DOCUMENTS

| | | | | |
|---|---|---|---|---|
| 6,317,097 | B1 | 11/2001 | Smith | |
| 6,900,772 | B2 | 5/2005 | Pulver | |
| 2004/0160372 | A1* | 8/2004 | Pulver | H01Q 1/362 343/725 |
| 2010/0078203 | A1* | 4/2010 | Lier | H01Q 11/08 342/365 |

FOREIGN PATENT DOCUMENTS

| | | |
|---|---|---|
| WO | WO 2004/059786 | 7/2004 |
| WO | WO 2007/123504 | 11/2007 |

OTHER PUBLICATIONS

AntennaFrequencyScalingTheARRLAntennaBook 1988pp. 2-24to2-25.*

PCT/IB2013/055182 International Search Report dated Sep. 30, 2014 (5 pages including English translation).

Djordjevic et al., "*Why does reflector enhance the gain of helical antennas*?", The Second European Conference on Antennas and Propagation (EuCAP 2007), Nov. 11-16, 2007, EICC, Edinburgh, UK, The Institution of Engineering and Technology, Source information: pp. 1-8, Publication Info: (XP002714356) the whole document.

Dragan et al., "*On the optimal dimensions of helical antenna with truncated-cone reflector*", Antennas and Propagation, 2006, EuCAP 2006, First European Conference on IEEE, Nov. 6, 2006, Piscataway, NJ, USA—Source Information: pp. 1-6, Publication Info: XP03I393568 the whole document.

* cited by examiner

CIRCULARLY POLARIZED COMPACT HELICAL ANTENNA

This application claims priority to International Application No. PCT/IB2013/055182 filed Jun. 24, 2013; French Application No. 1352446 filed Mar. 19, 2013; and U.S. Provisional Appln. No. 61/663,324 filed Jun. 22, 2012; the entire contents of each are incorporated herein by reference.

TECHNICAL FIELD OF THE INVENTION

The present invention relates to a circularly polarized compact helical antenna that is capable of being used in RFID devices and more particularly in RFID readers. Said antenna is intended to transmit or receive signals in the UHF band and more particularly in the ISM band.

PRIOR ART

Helical antennas are well known in the field of wireless communications because, in axial mode, they are able to provide a high gain over a relatively wide frequency band with good circular polarization.

Conventionally, they have a helicoidal radiating element made of conductive material extending along a longitudinal axis and a ground conductor connected to one of the ends of said element. The axial length of the radiating element is generally equal to several times the wavelength of the signals transmitted or received and the ground conductor is in the form of a plate or a hollow element such as a cylindrical or frustoconical cavity.

The performance of such antennas is described in the document entitled "Enhancing the gain of helical antennas by shaping the ground conductor" by A. R Djordjevic and A. G. Zajic, IEEE Antennas and wireless propagation letters, vol. 5, 2006. II This document notably describes the performance of three antennas designed to operate in the frequency band [1250 MHz, 2150 MHz]:

- a single-wire helical antenna with a ground plane of finite size and of square or circular shape;
- a single-wire helical antenna with a cylindrical cavity forming the ground plane; and
- a single-wire helical antenna with a frustoconical cavity.

In the three cases, the antenna has a helicoidal radiating element having an axial length L=684 mm, a turn diameter D=56 mm and a helical winding angle $\alpha$ (or pitch angle) of 13.5°. The radiating element is of circular cross-section and its diameter d is equal to 2 mm. If $\lambda_c$ denotes the wavelength associated with the minimum frequency (1250 MHz) of the frequency band [1250 MHz, 2150 MHz], the radiating element has the following dimensions: $L=3.87\lambda_c$ and $D=0.31\lambda_c$.

In the case of the single-wire helical antenna with a ground plane of circular or square shape, the diameter or the side length recommended for the ground plane is between $0.5\lambda_c$ and $0.75\lambda_c$. Over this range, the gain is very low band but it can attain 14.4 dB. In the case of a helical antenna with a square ground plane, a ground plane having a side of length equal to $1.5\lambda_c$ makes it possible to maximize the average gain over the frequency band. The maximum gain (or peak gain) of the antenna is thus 14.3 dB.

In the case of the single-wire helical antenna with a cylindrical cavity, it has been determined that the optimum dimensions for the cavity are as follows: diameter $D'=1\lambda_c$ and height $H'=0.25\lambda_c$. The presence of the cylindrical cavity makes it possible to increase the gain by 1 dB compared to the antenna with a square ground plane.

Finally, in the case of the single-wire helical antenna with a frustoconical cavity, the optimum dimensions are as follows: small diameter (in lower part of the cavity) $D'_1=0.75\lambda_c$, large diameter (in upper part of the cavity) $D'_2=2.5\lambda_c$, and height $H'=0.5\lambda_c$. The presence of the frustoconical cavity has made it possible to increase the gain by 3.4 dB compared to the antenna with a square ground plane. It has likewise been stated that the presence of the frustoconical cavity makes it possible to obtain a lower axial ratio and weaker secondary lobes.

Although this document shows that the antennas with a cylindrical or frustoconical cavity have good performance in terms of axial gain and directivity, it is nevertheless the case that the antennas proposed in this document are not compact, since the helicoidal radiating element forming the helix has an axial length corresponding to several wavelengths.

It is an object of the invention to propose a circularly polarized helical antenna which is compact, that is to say having a helicoidal radiating element of relatively small axial length, in order to be able to be placed in a relatively small space, for example in the false ceiling of a room.

It is another object of the invention to propose a helical antenna having a high gain over a relatively wide bandwidth with good circular polarization.

It is another object of the invention to propose a circularly polarized helical antenna having a constant high gain over an extended frequency band.

It is another object of the invention to propose a circularly polarized helical antenna having good directivity.

SUMMARY OF THE INVENTION

The invention relates to a circularly polarized directional helical antenna capable of transmitting or receiving radio-frequency signals in a predetermined frequency band, $\lambda$ being the wavelength associated with the minimum frequency of said predetermined frequency band, comprising a helicoidal radiating element made of conductive material extending along a longitudinal axis, and a cavity made of conductive material having an open end and a closed end and having an axis of symmetry that substantially coincides with the longitudinal axis of the radiating element, at least one lower portion of said radiating element being arranged inside said cavity so that the lower end of the helicoidal radiating element is in contact with the closed end of the cavity, characterized in that the axial length of the radiating element is less than the wavelength $\lambda$.

The relatively small axial length of the radiating element makes it possible to obtain a compact antenna without any adverse effect on the performance of the antenna.

According to a first embodiment, the axial length of the radiating element is substantially equal to $0.865\lambda$.

If the antenna has a cylindrical cavity, the height of said cavity is thus advantageously between $0.4\lambda$ and $0.88\lambda$ and the radius of the cavity is between $0.92\lambda$ and $1.05\lambda$. Preferably, the height of said cavity is equal to $0.60\lambda$ and the radius of the cavity is equal to $0.98\lambda$.

If the antenna has a frustoconical cavity, the height of said cavity is advantageously between $0.4\lambda$ and $0.88\lambda$, the base radius of the cavity is thus between $0.54\lambda$ and $0.65\lambda$ and the top radius of the cavity is between $1.15\lambda$ and $1.35\lambda$. Preferably, the height of said cavity is equal to $0.60\lambda$, the base radius of the cavity is equal to $0.54\lambda$ and the top radius of the cavity is equal to $1.15\lambda$.

According to another embodiment that is even more compact, the axial length of the radiating element is substantially equal to 0.288λ and the open end of the cavity is equipped with a periodic metal structure allowing the height of the cavity to be reduced. The periodic metal structure is a wire mesh network.

According to an embodiment with a cylindrical cavity, the height of the cavity may be reduced to 0.45λ, the radius of the cavity remaining equal to 0.98λ and the mesh width being between 0.27λ and 0.30λ.

According to an even more refined embodiment, the internal surface of the cavity is covered with a meta-material layer so as to reduce the height of the cavity even more.

Other advantages will emerge for a person skilled in the art upon reading the examples below, which are illustrated by the attached figures and given by way of illustration.

DETAILED DESCRIPTION OF AT LEAST ONE EMBODIMENT

The invention will be illustrated by means of various exemplary embodiments of a circularly polarized helical antenna capable of operating in the frequency band [865 MHz-965 MHz] corresponding to the frequencies dedicated to worldwide ISM applications. RFID more particularly uses the 865-868 MHz band in Europe and the 902 MHz-928 MHz band in the USA.

In the description which follows, λ denotes the wavelength associated with the frequency of 865 MHz. The dimensions of the antenna in the various embodiments are defined in relation to this wavelength.

First Embodiment

Figure 1:
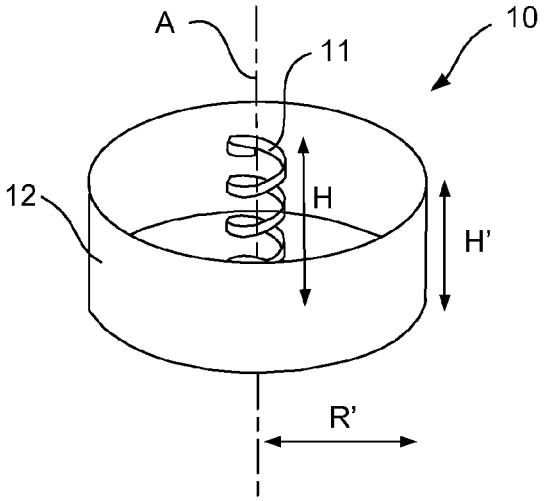
FIG. 1 shows a schematic perspective view of a helical antenna according to a first embodiment of the invention with a cylindrical cavity.
Figure 2:
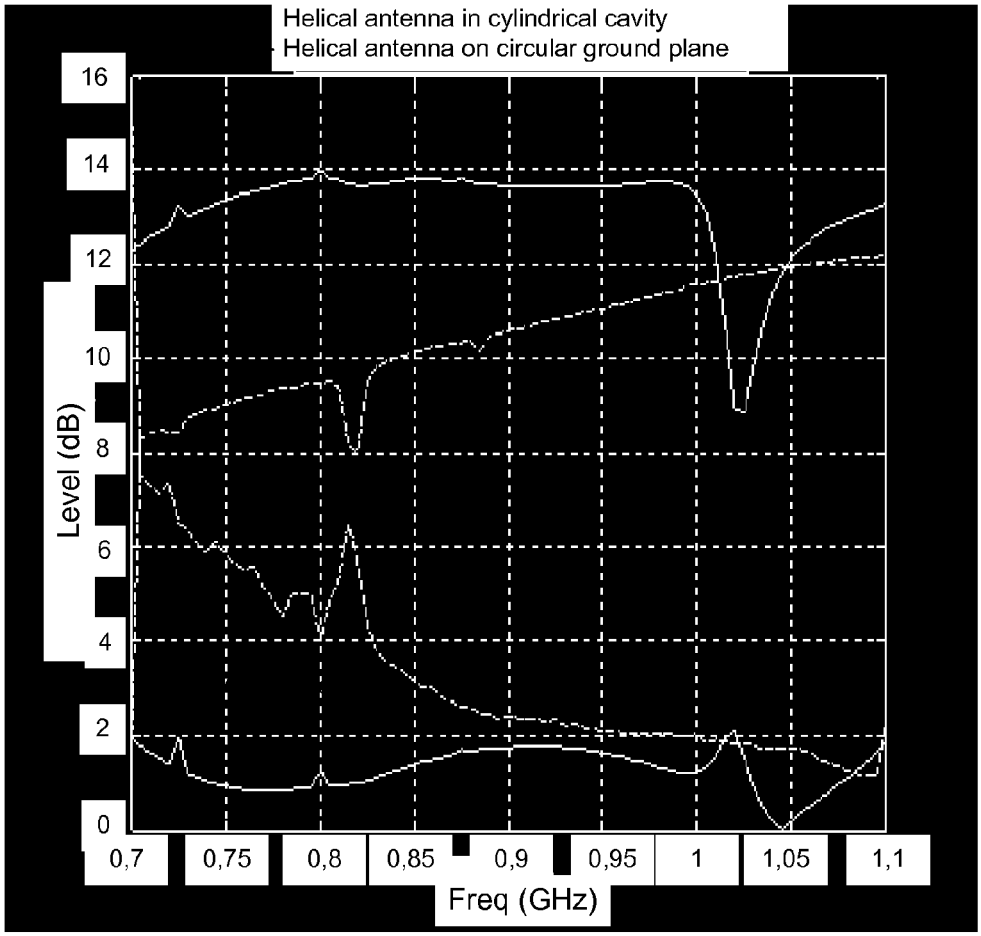
FIG. 2 shows the gain and axial ratio curves for the helical antenna of FIG. 1 and for a helical antenna with a circular ground plane as a function of frequency.
Figure 3:
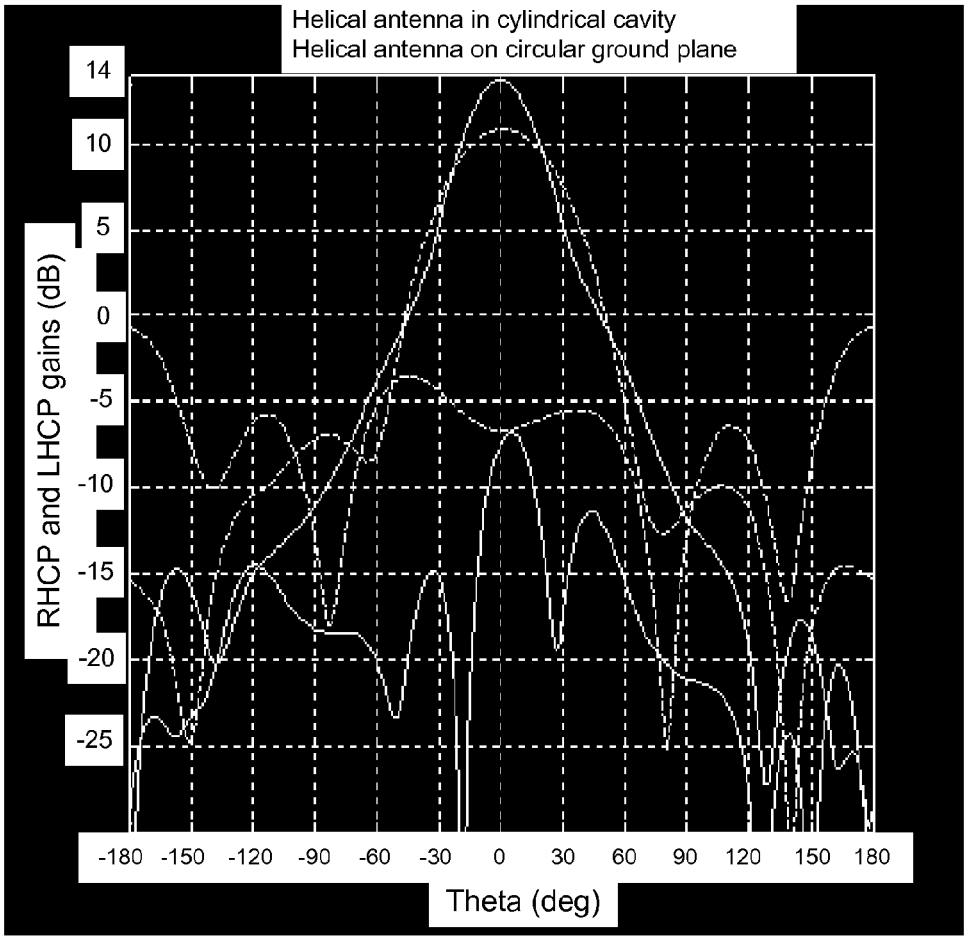
FIG. 3 shows the RHCP and LHCP gain of the antenna of FIG. 1 and of the helical antenna with a circular ground plane as a function of its degree of aperture.

According to a first embodiment that is illustrated by FIGS. 1 to 3, the helical antenna, referenced 10 in FIG. 1, has a helicoidal radiating element 11 made of conductive material extending along a vertical axis A and a cylindrical cavity 12 made of conductive material, the axis of symmetry of which coincides with the longitudinal axis A. The cavity has a bottom in the lower part and is open at the top. The lower end of the radiating element 11 is electrically connected to the bottom of the cavity.

The radiating element 11 has the following features:

height (axial length) H=30 cm=0.865λ, winding diameter D=11 cm=0.32λ, element width L=2 cm=0.057λ, and winding angle α=12.5°.

The length of each winding of the element has a length substantially equal to the wavelength λ.

The dimensions of the cylindrical cavity are:

height H'=21 cm=0.60λ, radius R'=34 cm=0.98λ.

The gain and axial ratio curves for the antenna 10 are shown in FIG. 2 and can be compared with those of an identical antenna comprising a circular ground plane of radius R'=34 cm instead of the cylindrical cavity, which are likewise shown in FIG. 2.

As can be seen from these curves, the gain of the antenna 10 is high and constant, in the order of 13.7 dB, over the band [800 MHz, 980 MHz] which is indeed wider than the frequency band desired for world passive RFID applications, or in practice for 865 MHz to 965 MHz. Similarly, the ISM bands around 2.45 GHz and 5.8 GHz require no more than 150 MHz of bandwidth. It is higher by at least 2.2 dB than that of the antenna with a circular ground plane.

The axial ratio of the antenna 10 varies between 1.5 dB and 1.8 dB over the desired frequency band. By comparison, the axial ratio of the antenna with a circular ground plane varies between 2 dB and 5 dB. The antenna 10 thus has very good circular polarization.

FIG. 3 shows the performance in terms of directivity of the antenna 10 with a cylindrical cavity and of the antenna with a circular ground plane at the frequency of 865 MHz. As can be seen in this figure, the mid-power angle of aperture of the antenna 10 with a cylindrical cavity (=34°) is smaller than that of the antenna with a circular ground plane (=55°), which allows better directivity to be obtained.

All of the performance data for the antenna 10 with a cylindrical cavity and for the antenna with a circular ground plane at the frequency of 865 MHz are recapitulated in the table below:

| | Short antenna with a circular ground plane | Short antenna with a cylindrical cavity |
|---|---|---|
| Gain | 11 dB | 13.7 dB |
| Axial ratio | 2.2 dB | 1.5 dB |
| Mid-power aperture | 55° | 34° |
| Bandwidth | >500 MHz | >500 MHz |

The antenna 10 is thus particularly advantageous in terms of gain (>13.7 dB), polarization (axial ratio <2 dB), directivity (mid-power aperture angle in the order of 30°) and bandwidth (>500 MHz). Moreover, the gain is substantially constant over a wide frequency band.

It should be noted that the dimensions of the cavity may vary without any great adverse effect on the performance mentioned above. It has been stated that, in order to obtain a maximum aperture of 36°, it is advisable to observe the following dimension ranges for the cavity:

| | Dimension range |
|---|---|
| Cavity height H' | 0.4 λ < H' < 0.88 λ |
| Cavity radius R' | 0.92 λ < R' < 1.05 λ |

It is possible to use other shapes of cavities, for example a frustoconical or substantially frustoconical cavity (truncated cone made from a plurality of substantially identical polygons).

Second Embodiment

Figure 4:
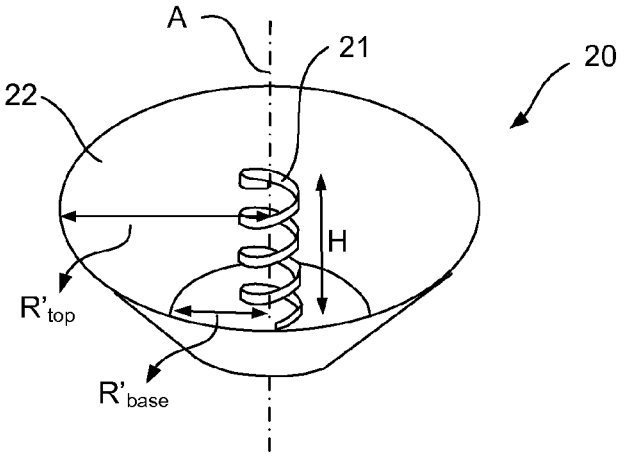
FIG. 4 shows a schematic perspective view of a helical antenna according to a second embodiment of the invention with a frustoconical cavity.
Figure 5:
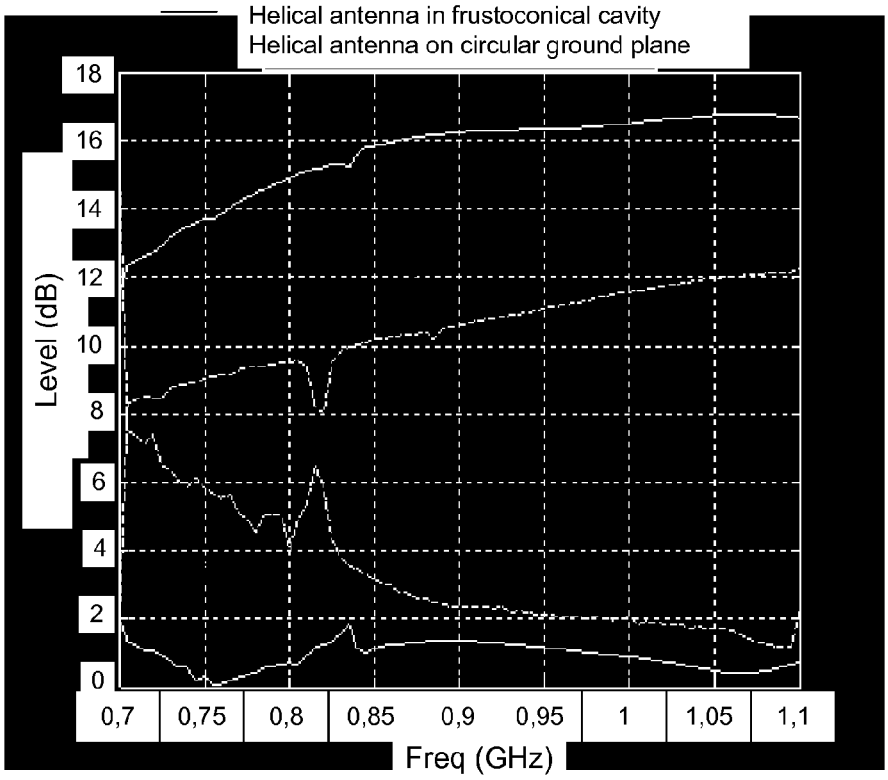
FIG. 5 shows the gain and axial ratio curves with a helical antenna of FIG. 4 and for a helical antenna with a circular ground plane as a function of frequency.
Figure 6:
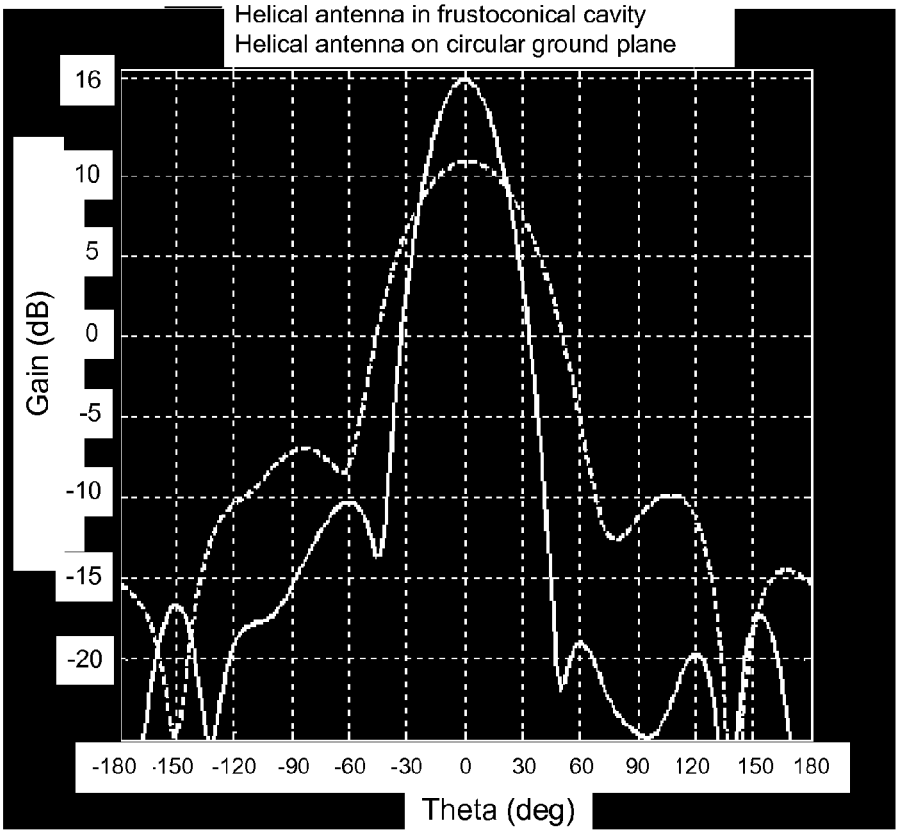
FIG. 6 shows the RHCP and LHCP gains of the antenna of FIG. 4 and of the helical antenna with a circular ground plane as a function of its degree of aperture.

Such a variant with a frustoconical cavity is illustrated by FIGS. 4 to 6. The antenna, referenced 20, comprises a helicoidal radiating element 21 that is identical to the radiating element 11 and a frustoconical cavity 22, the axis of symmetry of which coincides with the axis A of the element. The frustoconical cavity 22 has a bottom in the lower part and is open at the top. The lower end of the radiating element 21 is electrically connected to the bottom of the frustoconical cavity.

The dimensions of the frustoconical cavity are:

height H'=21 cm=0.60λ, radius $R'_{top}$=40 cm=1.15λ, radius $R'_{base}$=19 cm=0.54λ.

The gain and axial ratio curves for the antenna 20 are shown in FIG. 5 and can be compared with those of the identical antenna comprising a circular ground plane which have already been shown in FIG. 2 and which are reprised in FIG. 5.

As can be seen in this figure, the gain of the antenna 20 is relatively constant over the frequency band [850 MHz, 950 MHz]. It is moreover very high, beyond 16 dB, and is higher by at least 4 dB in relation to that of the antenna with a circular ground plane.

The axial ratio is in the order of 1.5 dB over the frequency band [850 MHz-950 MHz]. It is lower by at least 1 dB than that of the antenna with a circular ground plane.

FIG. 6 shows the directivity performance of the antenna 20 at the frequency of 865 MHz. As can be seen in this figure, the mid-power aperture angle of the antenna 20 with a frustoconical cavity is smaller than that of the antenna with a circular ground plane, which allows better directivity to be obtained.

All of the performance data for the antenna 20 with a frustoconical cavity and for the antenna with a circular ground plane at 865 MHz are recapitulated in the table below:

| | Short antenna with a circular ground plane | Short antenna with a cylindrical cavity |
|---|---|---|
| Gain | 11 dB | 16.1 dB |
| Axial ratio | 2.2 dB | 1.3 dB |
| Mid-power aperture | 55° | 30° |
| Bandwidth | >500 MHz | >500 MHz |

The antenna 20 with a frustoconical cavity is therefore even more advantageous than the antenna 10 with a cylindrical cavity in terms of gain (16.1 dB), polarization (axial ratio <1.5 dB) and directivity (mid-power aperture angle in the order of 30°).

The dimensions of the frustoconical cavity may vary without any great adverse effect on the performance mentioned above. It has been stated that, in order to obtain a maximum aperture of 30°, it is advisable to observe the following dimension ranges for the cavity:

| | Dimension range |
|---|---|
| Cavity height H' | 0.4 λ < H' < 0.88 λ |
| Base radius $R'_{base}$ | 0.54 λ < R' < 0.65 λ |
| Top radius $R'_{top}$ | 1.15 λ < R' < 1.35 λ |

Third Embodiment

It is possible to further reduce the height of the radiating element and the height of the cavity without adversely affecting the performance of the antenna. To this end, the cavity is advantageously equipped, at its open end, with a periodic metal structure forming a frequency-selective surface. In the description which follows, this periodic structure is denoted by the acronym FSS (Frequency Selective Surface). In this embodiment, the whole of the radiating element is placed inside the cavity.

Such an embodiment with a cylindrical cavity and FSS is shown by FIGS. 7 to 10.

Figure 7:
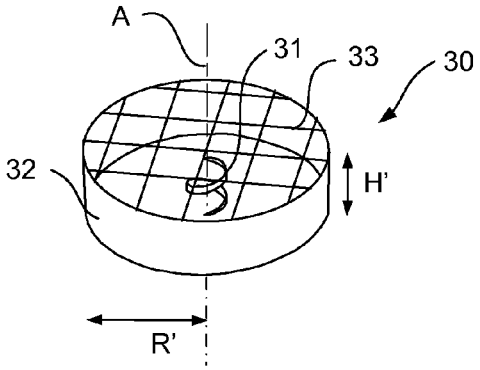
FIG. 7 shows a schematic perspective view of a helical antenna according to a third embodiment of the invention with a cylindrical cavity and a periodic metal structure FSS.
Figure 8:
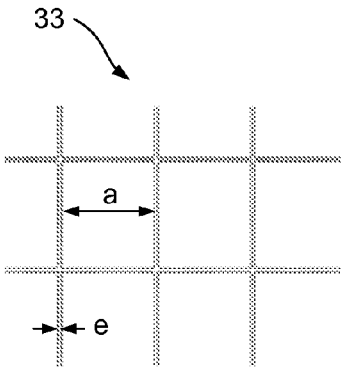
FIG. 8 is a schematic view of a portion of a periodic metal structure FSS of the antenna of FIG. 7.

With reference to FIGS. 7 and 8, the antenna, referenced 30, comprises a helicoidal radiating element 31 arranged inside a cylindrical cavity 32. The open end of the cavity is equipped with a periodic metal structure or FSS 33.

The radiating element 31 has the following features:

height H=10 cm=0.288λ, turn diameter D=11 cm=0.32λ, element width L=2 cm=0.057λ, and winding angle of 12.5°.

The dimensions of the cylindrical cavity 32 are:

height H'=15.5 cm=0.45λ, radius D'=34 cm=0.98λ.

The periodic metal structure 33 is in the form of wire netting comprising a plurality of square meshes. The length a of the mesh and the thickness e of the metal wires forming the netting are equal to 0.288λ and 0.008λ, respectively. These values correspond to a reflectivity of 21%, the value from which the energy leaving the cavity can be directed and thus good directivity can be obtained.

Figure 9:
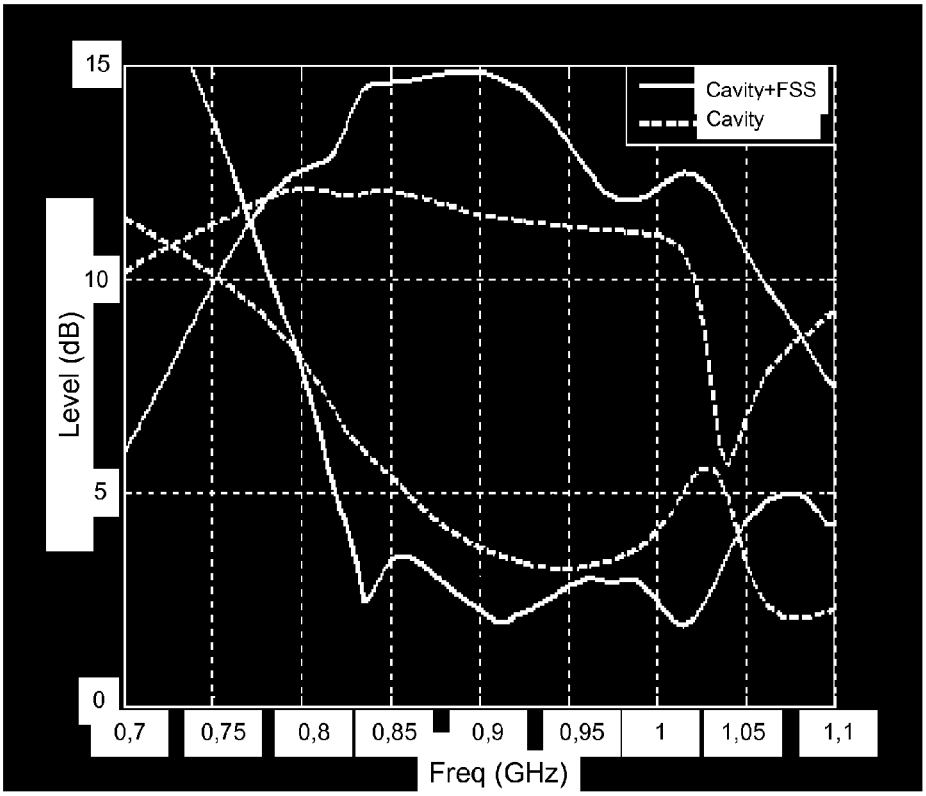
FIG. 9 shows the gain and axial-ratio curves for the helical antenna of FIG. 7 with and without a periodic metal structure FSS as a function of frequency.

The gain and axial-ratio curves for the antenna 30 with and without an FSS structure are shown in FIG. 9.

As can be seen in this figure, the gain of the antenna 30 with an FSS structure reaches 14.9 dB around 900 MHz and is relatively constant over the band [840 MHz, 915 MHz]. In the absence of FSS, the gain varies only between 11 dB and 12 dB. The axial ratio of the antenna 30 with an FSS structure varies between 2 dB and 3.3 dB whereas it is higher than 3 dB in the absence of FSS.

Figure 10:
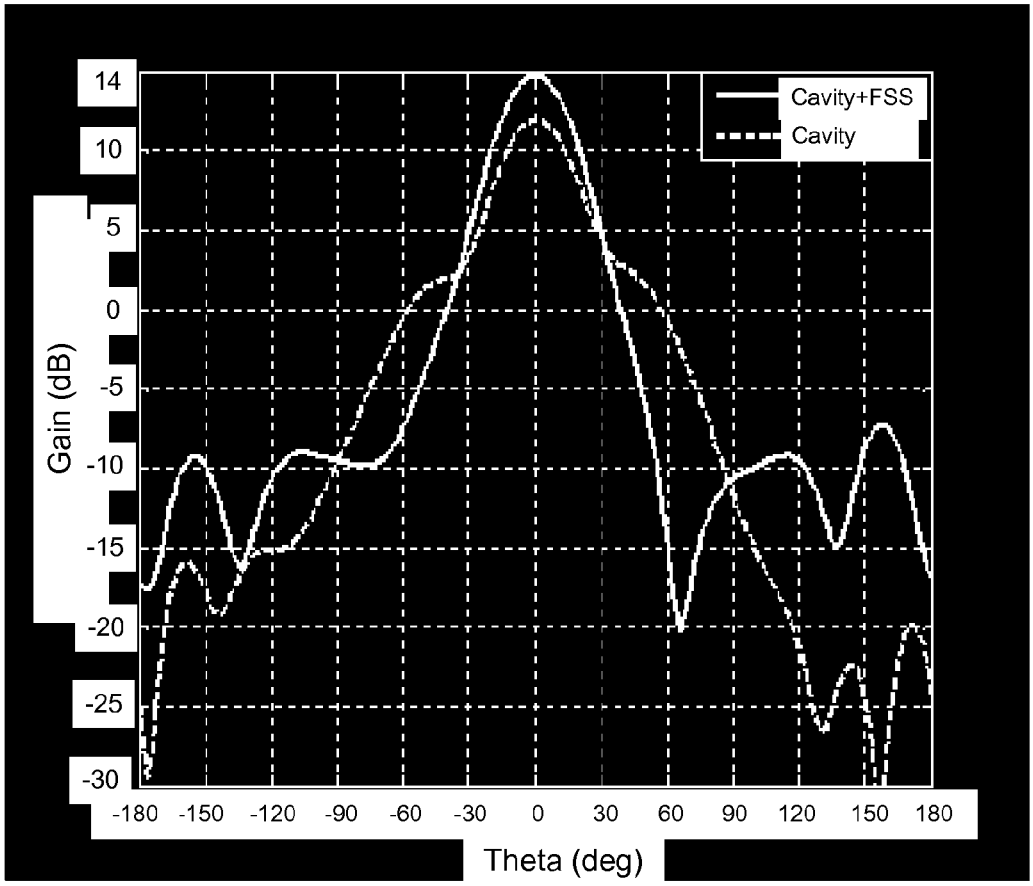
FIG. 10 shows the gain of the antenna of FIG. 7 with and without a periodic metal structure as a function of its degree of aperture.

In terms of directivity, FIG. 10 shows that the directivity of the antenna 30 with FSS and that of the antenna without FSS are substantially identical. The mid-power aperture angle is between 32° and 36°.

The performance data for the antenna 30 with and without FSS are recapitulated in the table below:

| | Short antenna with cylindrical cavity of low height | Short antenna with cylindrical cavity of low height and FSS |
|---|---|---|
| Gain | 12 dB | 14.6 dB |
| Axial ratio | 4.7 dB | 3.3 dB |
| Mid-power aperture | 36° | 32° |
| Bandwidth | 200 MHz | 185 MHz |

In relation to the antennas 10 and 20, the antenna 30 is particularly advantageous in terms of compactness, since its axial length is almost divided by two, that is to say 15.5 cm instead of 30 cm. This reduction in size is obtained without adversely affecting the gain and directivity of the antenna. By contrast, the circular polarization is slightly adversely affected (axial ratio in the order of 3 dB) as is the bandwidth.

The length a of the mesh and the thickness e of the wires forming the mesh may vary without adversely affecting the performance mentioned above. It has been stated that, in order to preserve a maximum aperture of 36°, it is advisable to observe the following dimension ranges for the mesh:

$$0.27\lambda<a<0.3\lambda \text{ and } 0.003\lambda<e<0.012\lambda.$$

Figure 11:
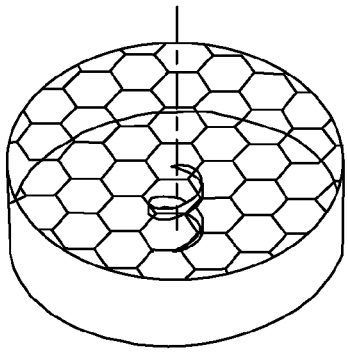
FIG. 11 is a variant of the embodiment of FIG. 7.

Equally, the shape of the mesh may vary. According to one variant embodiment, shown by FIG. 11, the mesh is a hexagonal shape so that the FSS has a honeycomb structure.

The FSS structure may be implemented in one or more layers of material so as to form a 2D or 3D structure.

According to another embodiment, which is not shown by the figures, it is likewise possible to further reduce the height of the cavity by depositing a meta-material layer onto the internal surface of the cavity and more particularly onto the bottom of the cavity. This meta-material layer makes it possible both to reduce the volume of the cavity and to increase the directivity of the antenna.

It goes without saying that the invention can be applied to frequency bands other than the band [865 MHz, 960 MHz].

By way of example, the invention can be applied to frequency bands around the frequencies 2.45 GHz and 5.8 GHz for remote monitoring or remote payment applications. An ISM band around 2.45 GHz, for example the 2400-2500 MHz band, can be used. Equally, for remote payment applications, it is possible to use the 5725-5875 MHz band around 5.8 GHz.

Although the invention has been described in connection with various particular embodiments, it is quite evident that it is in no way limited thereto and that it comprises all of the technical equivalents of the means described as well as combinations thereof if these are within the scope of the invention.

The invention claimed is:

1. A circularly polarized directional helical antenna configured to transmit or receive radio-frequency signals in a predetermined frequency band, λ, being the wavelength associated with the minimum frequency of the predetermined frequency band, comprising a helicoidal radiating element made of conductive material extending along a longitudinal axis (A), a cavity made of conductive material having an open end, a closed end, and having an axis of symmetry that substantially coincides with the longitudinal axis of the radiating element, with at least one lower portion of the radiating element being arranged inside said cavity so that the lower end of the helicoidal radiating element is in contact with the closed end of the cavity, wherein the axial length (H) of the radiating element is less than the wavelength A and the open end of the cavity is equipped with a periodic metal structure allowing the height of the cavity to be reduced, the periodic metal structure being in the form of metal wire netting comprising a plurality of square meshes, wherein a length of each mesh is between 0.27λ and 0.3λ; and a thickness of the metal wires forming the netting being between 0.003λ and 0.012λ.

2. The antenna according to claim 1, wherein the axial length of the radiating element is substantially equal to 0.288λ.

3. The antenna according to claim 2, wherein the cavity has cylindrical shape, the height of the cavity is substantially equal to 0.45λ, and the radius of the cavity is equal to 0.98λ.

4. The antenna according to claim 2, wherein the periodic metal structure is a wire mesh network having square mesh, the width (a) of the mesh being between 0.27λ and 0.30λ.

5. The antenna according to claim 1, wherein the internal surface of the cavity is covered with a meta-material layer.

* * * * *